US007185999B2

(12) United States Patent
Lui

(10) Patent No.: US 7,185,999 B2
(45) **Date of Patent: *Mar. 6, 2007**

(54) FLASHLIGHT WITH TOUCH SENSING ON/OFF OPERATION

(75) Inventor: Wing Kit Lui, Kowloon (HK)

(73) Assignee: Eric Beare Associates Ltd., Kowloon (HK)

( * ) Notice: Subject to any disclaimer, the term of this patent is extended or adjusted under 35 U.S.C. 154(b) by 22 days.

This patent is subject to a terminal disclaimer.

(21) Appl. No.: 11/127,475

(22) Filed: May 12, 2005

(65) Prior Publication Data

US 2005/0213317 A1 Sep. 29, 2005

(51) Int. Cl.
*F21L 4/00* (2006.01)

(52) U.S. Cl. ..... 362/157; 362/205; 362/394; 200/600

(58) Field of Classification Search ..... 362/157, 362/205, 206, 295, 394, 395, 600
See application file for complete search history.

(56) References Cited

U.S. PATENT DOCUMENTS 4,885,666 A 12/1989 Yu
5,205,637 A * 4/1993 Caspari ..... 362/109
6,388,390 B2 * 5/2002 Rachwal ..... 315/200 R

FOREIGN PATENT DOCUMENTS

GB 2039355 A * 8/1980

* cited by examiner

*Primary Examiner*—Stephen F Husar
*Assistant Examiner*—Meghan K. Dunwiddie
(74) *Attorney, Agent, or Firm*—Perkins Coie LLP

(57) ABSTRACT

A flashlight senses when it is picked up, and then automatically turns on. When the flashlight is released or set back down, it automatically turns off. Touch or contact sensors sense the touch of a human hand, causing a circuit in the flashlight to switch on a light source, such as an LED. The flashlight is advantageously designed so that when grasped or picked up, the fingers of the user's hand lay over touch sensors. Various types of touch sensors may be used. The touch sensors may operate electrically, and without any movement, or moving parts.

12 Claims, 4 Drawing Sheets

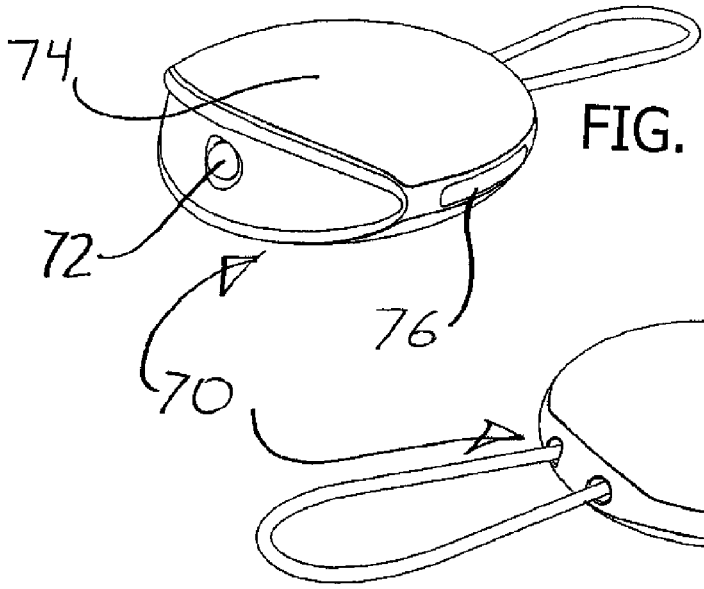
FIG. 7
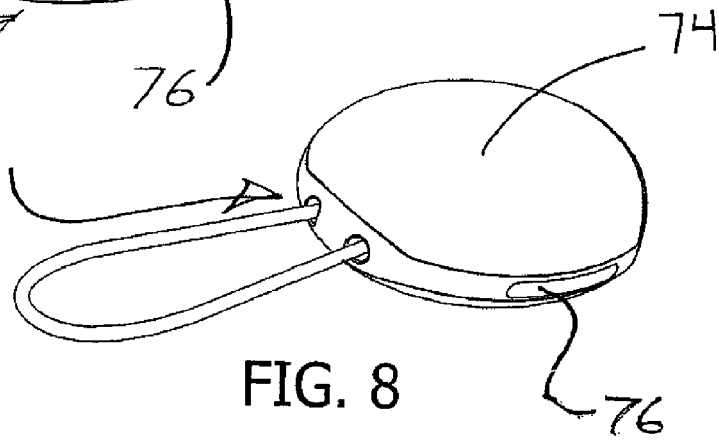
FIG. 8
FIG. 9
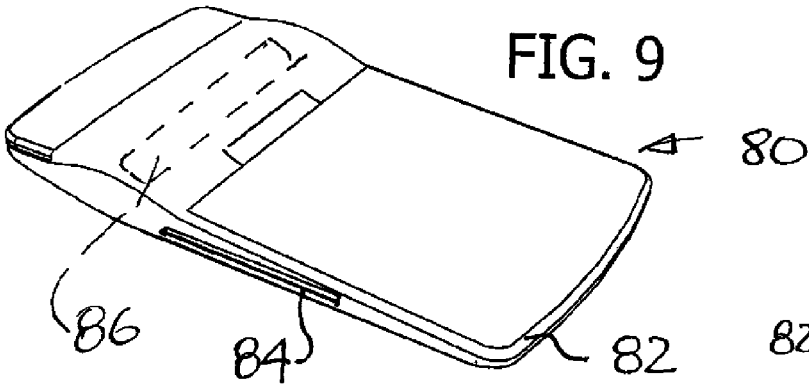
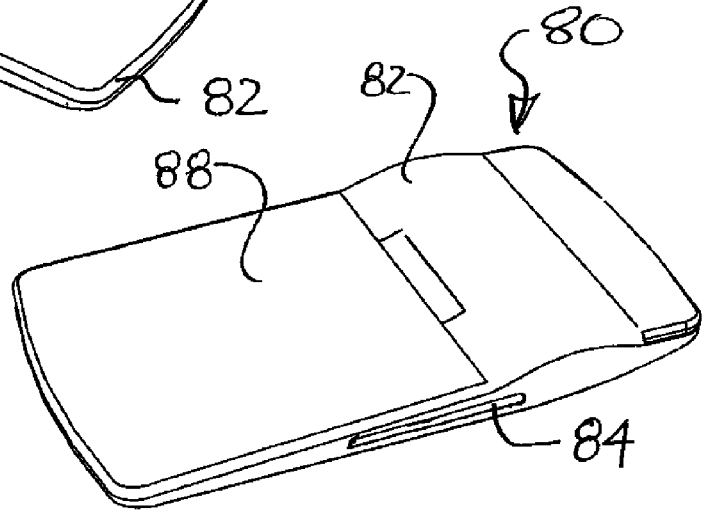
FIG. 10

FLASHLIGHT WITH TOUCH SENSING ON/OFF OPERATION

BACKGROUND OF THE INVENTION

Flashlights typically have an external switch used to turn the flashlight on and off. Various switches have been used on flashlights, including push-button switches, sliding switches, twist-on/twist-off switches, dial switches, and many others. These switches are generally mechanically actuated by the user's finger of thumb. However, switch actuation is necessary to turn the flashlight on. This can result in difficulty and/or delay, especially in dark conditions, where the switch cannot be seen, and when the user is not familiar with the flashlight design.

Other types of flashlights have switches that automatically turn the flashlight on when the flashlight is removed from a charger, wall socket, or other location. Alternatively, some flashlights automatically switch on when immersed in water, or when moved into a specific vertical or horizontal position, or when so other event occurs. While these automatic-on designs avoid the need for manually switching the flashlight on, they can also result in premature battery depletion.

Accordingly, there is a need for an improved flashlight design.

SUMMARY OF THE INVENTION

A new flashlight senses when it is picked up, and then automatically turns on. When the flashlight is released or set back down, it automatically turns off. In one aspect, the flashlight may have touch or contact sensors that can sense the touch of a human hand. The flashlight is advantageously designed so that when grasped or picked up, the fingers of the user's hand lay over touch sensors, causing the flashlight to turn on. Various types of touch sensors may be used. The touch sensors may operate electrically, and without any movement, or moving parts.

BRIEF DESCRIPTION OF THE DRAWINGS

In the drawings, wherein the same element number indicates the same element, in each of the views:

FIG. 7 is a front, top and right side perspective view of a keychain light.

FIG. 8 is a back, top and left side perspective view of the keychain light shown in FIG. 7.

FIG. 9 is a bottom, front and left side perspective view of mirror light.

FIG. 10 is a bottom, front and right side perspective view of the mirror light shown in FIG. 9.

DETAILED DESCRIPTION

Figure 1:
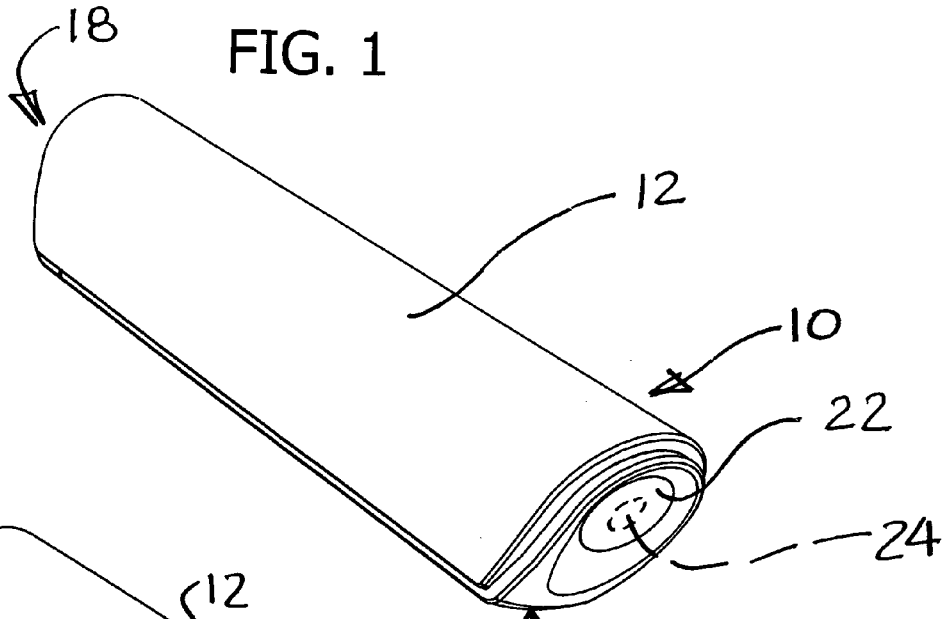
FIG. 1 is a front and top perspective view of the flashlight.
Figure 2:
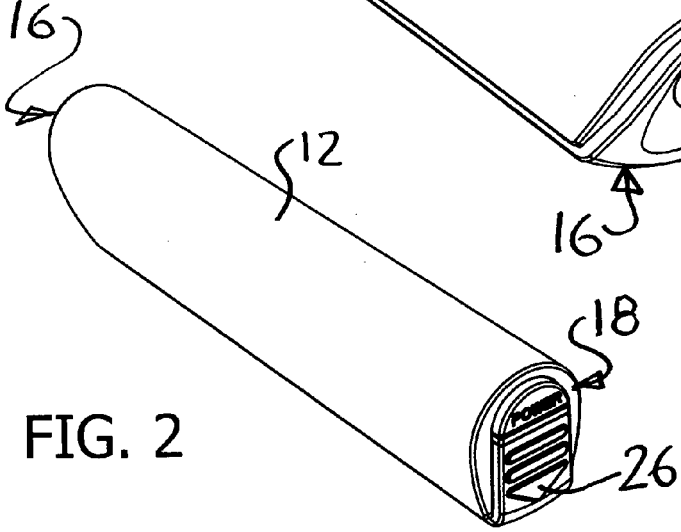
FIG. 2 is a back and top perspective view of the flashlight shown in FIG. 1.
Figure 3:
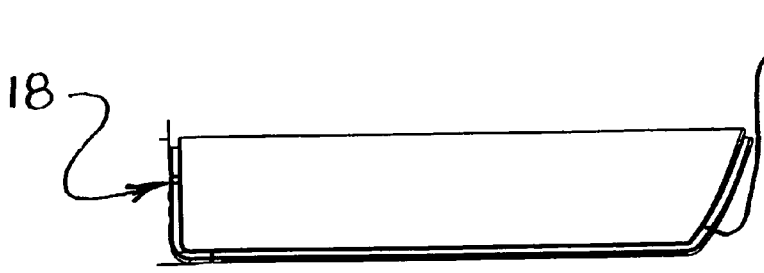
FIG. 3 is a side view of the flashlight shown in FIG. 1.
Figure 4:
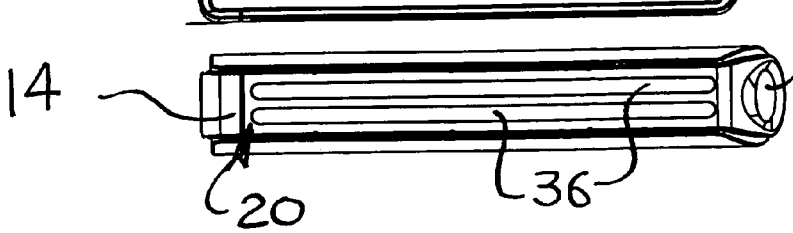
FIG. 4 is bottom view of the flashlight shown in FIG. 1.

The drawings show one of many different designs that may be used. The drawings are therefore simply examples of the flashlight may be designed. The drawings are not intended as a statement of the invention, or as limiting of the invention.

As shown in FIGS. 1–4, a flashlight 10 has a body or housing 12. A light source 24, such as an LED or incandescent bulb, and optionally a lens 22, are at a front end 16 of the housing 12. A door or cover 26 may be provided at the back end 18. The door 26 may be opened to access a battery compartment, to change the batteries. The flashlight advantageously may have a flat bottom surface 20. The bottom surface 20 may be formed as part of the housing 12, or as shown in the Figures, a base 14 may form the bottom surface 20.

Figure 5:
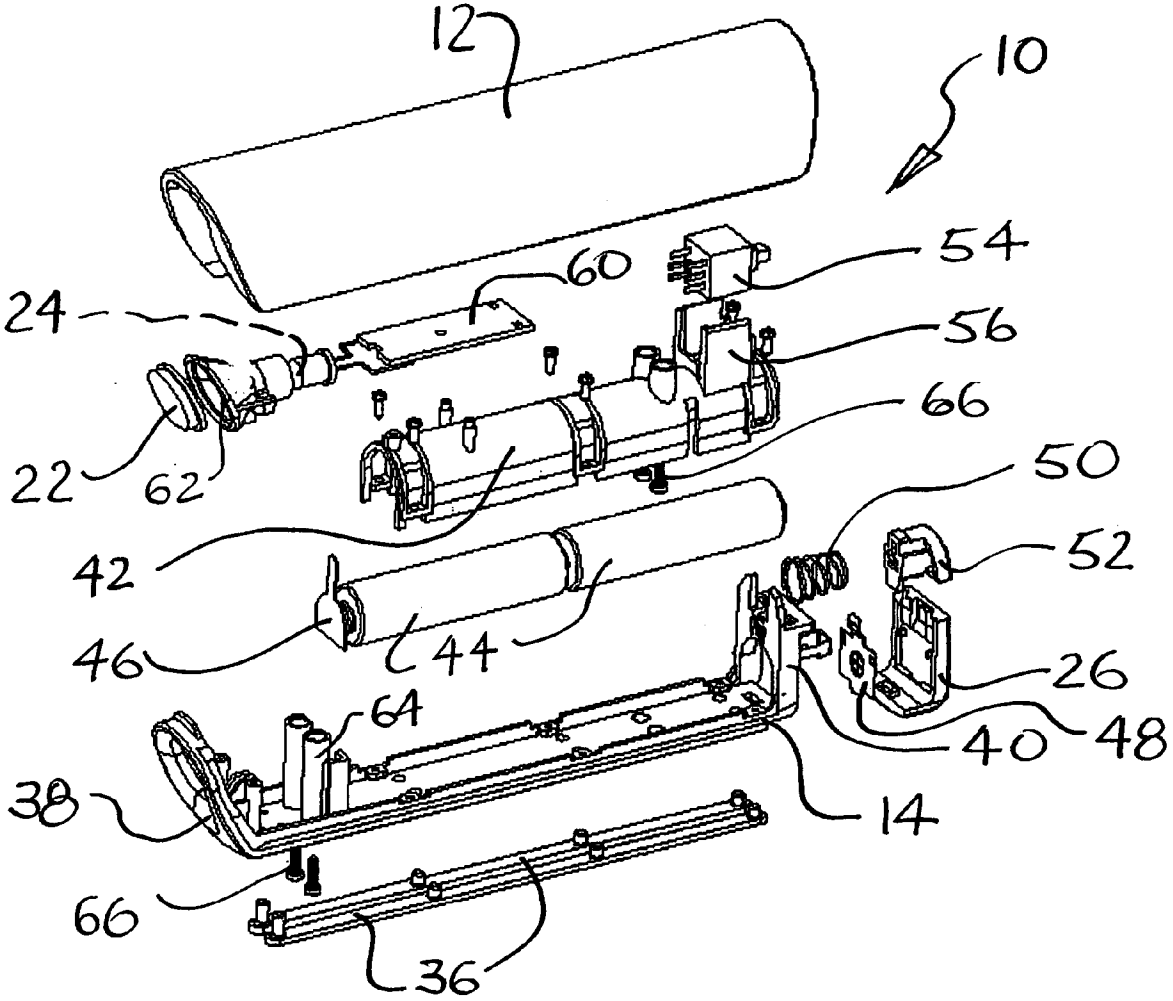
FIG. 5 is an exploded perspective view of the flashlight shown in FIG. 1.

Referring now also to FIG. 5, in the design shown, a separate base 14 is used. First and second contact bars or strips 36 are located on the bottom or outside facing surface of the base 14. The contact bars 36 may be generally parallel to each other, as well as parallel to a central axis of the generally cylindrical housing 12. If used, the base 14 may have an upward angled or extending front plate 38 and a rear plate 40. Then the front plate 38 may surrounds or be adjacent to the lens 22, and the door 26 can be supported on the back plate 40. A reflector 62 may optionally be provided around the light source 24. One or more batteries 44 can be placed in a battery compartment or space, formed between the base 14 and a battery cover or frame 42.

A mechanical micro-switch 54 can be supported in a switch holder 56 on the battery cover 42, actuated by a push button 52 biased outwardly by a spring 50. Front and back end battery contacts 46 and 48 make electrical connections to the batteries. A circuit board 60, if used, can be attached onto posts on the battery cover 42. The base 14 and housing 12 may be attached together via screws 66 in stand offs 64, as shown in FIG. 5. The specifics of the part selections, placement and mechanical attachment are not critical and can of course be varied, within the scope of the invention.

Figure 6:
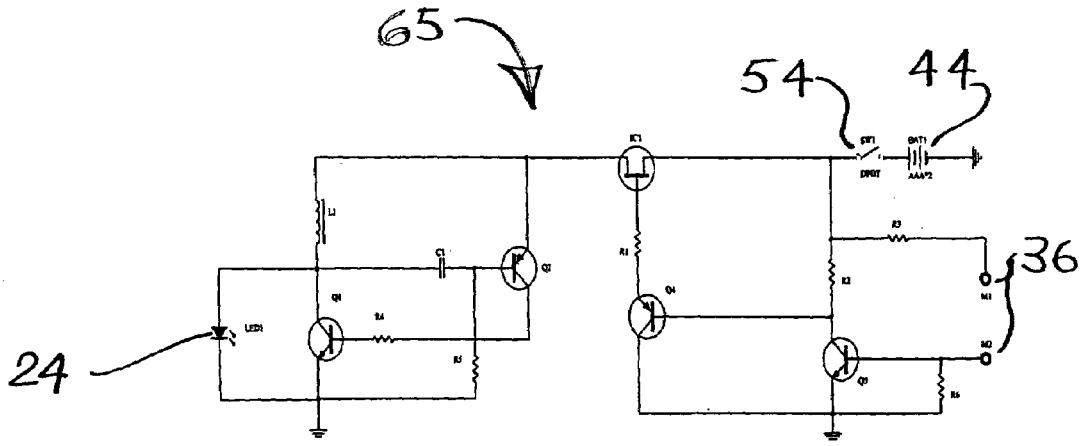
FIG. 6 is a schematic diagram of a circuit for use in the flashlight shown in FIG. 1.

FIG. 6 shows the electrical connections and circuit 65 of the flashlight 10. The positive side of the batteries 44 connects to the on/off switch 54. The touch or contact bars 36, which may be carbon contact bars, are connected across resistor R2 and transistor Q5, with further connections as shown between the other components, discrete or integrated. The light source or LED 24 is connected across Q1. Again, the design specifics of the circuit and electrical connections are not critical, so long as the automatic touch/turn function is provided.

In use, with the switch 54 in the off position, the flashlight remains off at all times, and battery power is conserved. With the switch 54 in the on position, the contacts 36 ordinarily act as an open switch. In this condition, the circuit 65 does not supply current to the LED 24. When the flashlight is grasped or picked up, the user's hand bridges the contact bars 36. The contact bars then act as a closed switch. The circuit 65 is switch on and current is provided to the LED 24. This continues until the flashlight is released by the user.

The flashlight 10 may include the housing 12, the base 14, or both in the design shown. The term housing element designates a housing, or a base, or a combination of a housing and a base. The contacts or contact bars 36 are on, or extend through to, an outside surface of the housing or the base, if used. The housing and/or base are typically made of plastic or metal, and are substantially rigid and incompressible, at least in ordinary use. The contact bars provide for touch detection without substantial deflection or movement. The contact bars remain stationary at all times, even when the flashlight is grasped or held in the hand of a user. The shape of flashlight therefore remains constant at all times, providing a secure feel in the user's hand. The contact bars may not necessarily provide any noticeable tactile feel to the user at all. Although shown in FIG. 5 as separate elements, the contact bars 36 may be made integral with a base 14, or with a housing 12.

Other forms of the contact bars 36 may of course also be used, to sense touch. These include other electrical conduction or continuity elements, such as contact points or arrays, inductive or capacitive change sensors, pressure sensitive elements, heat sensitive elements, optical devices, etc.

FIGS. 7 and 8 show a keychain light 70 also having a touch/on feature. The keychain light 70 has a light source or LED 24 on a body or housing 74. Touch or contact bars, strips or sensors 76 are located on opposite sides of the housing 74. The contact bars 76 operate in a way similar to the contact bars 36 shown in FIG. 5. When the keychain light 70 is picked up, the LED 24 turns on, as explained above in connection with the flashlight 10.

FIGS. 9 and 10 show a touch light mirror 80 also having a touch/on feature as described above. The touch light mirror 80 may have contact strips 84 on opposite sides of a case 82. When the case is picked up, and the user's hand touches the contact strips 84, a light or LED 86 in or on the case turns on. The touch light mirror 80 may have one or more flip open covers 88. If so, the circuit 65 used in the touch light mirror may also be designed so that the light 86 remains off until a cover is opened.

As shown in FIGS. 7–10, the invention relates to other devices having a light source, in addition to flashlights. The term flashlight, as used here, means these other types of devices as well.

Thus, a novel flashlight has been shown and described. Various changes and substitutions can of course be made without departing from the spirit and scope of the invention. The invention, therefore, should not be limited, except by the following claims, and their equivalents.

The invention claimed is:

1. A flashlight comprising:

an elongate flashlight housing having at least one substantially flat surface;

a light source and a power source supported at least in part by the housing, and with the light source at a front end of the housing;

first and second touch contacts on the housing, with the first and second touch contacts comprising generally elongate parallel strips;

a power switch adjacent to a back end of the housing; and a circuit for linking the power source to the light source when the first and second contacts are bridged by a user's hand, and when the power switch is in an on position.

2. The flashlight of claim 1 with the power source comprising one or more batteries in the housing linked to the circuit, and wherein the light source comprises one or more LEDs, and where the contact strips sense contact by conduction of electrical current from one sensor to the other.

3. The flashlight of claim 1 wherein the contact strips are substantially immovably fixed relative to the housing and to each other.

4. The flashlight of claim 1 with the contact strips on opposite sides of the housing.

5. A flashlight comprising:

a substantially rigid elongated housing;

at least one LED at a front end of the housing;

at least one battery in the housing;

first and second touch contacts substantially immovably fixed in place relative to each other on opposite sides of the housing;

a power switch on the housing;

a circuit in the housing for linking the battery to the light source when the first and second contacts are connected by a user's hand, and when the power switch is closed.

6. The flashlight of claim 5 wherein the first and second touch contacts comprise substantially elongate and parallel bars.

7. The flashlight of claim 5 with the circuit including detection means for detecting when a users hand is contacting both contact bars.

8. The flashlight of claim 7 with the touch detection means detecting touch without any movement or deformation of the housing.

9. The flashlight of claim 7 wherein the touch detection means operates electrically and without need for any mechanical movement of any element of the flashlight.

10. The flashlight of claim 5 wherein the housing is substantially cylindrical and with the contact bars substantially parallel to each other and to the cylindrical housing.

11. The flashlight of claim 5 wherein the power switch is a push button switch located at the back end of the housing.

12. A flashlight comprising:

a base;

a light source and a power source supported at least in part by the base;

first and second touch contacts comprising elongate contact bars on an outside surface of the base;

a circuit for linking the power source to the light source when the first and second contacts are bridged by a user's hand; and a generally cylindrical housing attached to the base and enclosing the light source, the power source and the circuit, with the housing including a front end and a back end, and with the contact bars extending substantially from the front end to the back end.

* * * * *